United States Patent [19]

Locanetto et al.

[11] Patent Number: 4,925,387

[45] Date of Patent: May 15, 1990

[54] PROCESS AND APPARATUS INTENDED TO EFFECT STAGED COMBUSTION OF A MIXTURE OF FUEL AND COMBURENT TO REDUCE THE PRODUCTION OF NITROGEN OXIDES

[76] Inventors: Philippe Locanetto, 108, rue de Meaux, 93410 Vaujours; Frédéric Bury, Chemin de Gramenoue, 13190 Allauch; Jacques Pizzut, Les Demerures de Candole n° 8, 13821 La Penne Sur Huveaune, all of France

[21] Appl. No.: 284,098

[22] Filed: Dec. 14, 1988

[30] Foreign Application Priority Data

Dec. 24, 1987 [FR] France ..... 87 18144

[51] Int. Cl.[5] ..... F23C 7/00

[52] U.S. Cl. ..... 431/187; 431/189; 431/284; 431/285

[58] Field of Search ..... 431/8, 174, 187, 189, 431/284, 285, 279, 186; 60/748

[56] References Cited

U.S. PATENT DOCUMENTS

| | | | |
|---|---|---|---|
| 3,180,395 | 4/1965 | Reed | 431/285 X |
| 3,260,301 | 7/1966 | Zoschak et al. | 431/284 X |
| 3,700,376 | 10/1972 | Niepenberg et al. | |
| 3,822,110 | 7/1974 | Paredes et al. | 431/189 X |
| 4,347,052 | 8/1982 | Reed et al. | 431/284 X |
| 4,465,459 | 8/1984 | Benninghoven | 431/189 X |
| 4,505,666 | 3/1985 | Martin et al. | 431/285 X |

FOREIGN PATENT DOCUMENTS

| | | |
|---|---|---|
| 2759084 | 7/1978 | Denmark . |
| 0076036 | 6/1983 | European Pat. Off. . |
| 2319846 | 2/1977 | France . |

*Primary Examiner*—Randall L. Green

*Attorney, Agent, or Firm*—Thomas R. Morrison

[57] ABSTRACT

The invention relates to a process and an apparatus intended to effect the combustion of a mixture of air and liquid or gaseous fuel, wherein the injection of the fuel is staged without that of the air for combustion being staged. According to the invention, in addition to the primary means (20, 34) for injecting fuel into the passage (10, 14) supplying air to the burner, secondary injection means (24) mounted inside said passage are provided and comprise a main part (24*a*) which is extended by a terminal part (24*b*) bent in such a manner that the end of said terminal part is situated downstream of the end of the primary means (20, 34) and at a distance from the axis (2) of said passage which is greater than the minimum section of the latter. The invention is applicable both to so-called parallel air admission burners and to burners having swirl vanes.

20 Claims, 4 Drawing Sheets

PROCESS AND APPARATUS INTENDED TO EFFECT STAGED COMBUSTION OF A MIXTURE OF FUEL AND COMBURENT TO REDUCE THE PRODUCTION OF NITROGEN OXIDES

The present invention relates to burners for liquid or gaseous fuels, intended to be mounted opposite an aperture provided for the purpose in the wall of a vessel, such as the combustion chamber or the hearth of a furnace or boiler.

Speaking generally, the burner according to the invention is of the type comprising an air box which opens onto a duct which, together with said aperture, forms a passage for the air for combustion, and primary fuel injection means leading into the air supply passage.

In order to combat pollution due to the production of oxides of nitrogen, it has for a long time been considered advantageous in this type of burner to stage the combustion, that is to say to proceed by stages instead of bringing all the fuel and all the combustion agent together in a single zone. The maximum flame temperatures can thus be limited and the amount of oxygen decreased, which has the effect of reducing the production of nitrogen oxides.

Up to the present time the method mainly studied and used consisted in staging the injection of the combustion agent, without modifying the injection of the fuel.

The present invention seeks to make improvements to burners of the type defined above to enable the staging of the injection of the fuel to be achieved in a simple manner without staging the injection of the combustion agent, thus achieving the advantage that these improvements can be applied to existing known burners.

To this end, the burner forming the object of the invention is characterized in that secondary fuel injection means are mounted directly in the air supply passage and comprise a main part and a terminal part which together form an angle not equal to zero, so that the end of this terminal part will be situated at a distance from the axis of the passage greater than the minimum section of the latter and will lead out downstream of the end of the primary injection means.

Without having to make openings in either the wall of the vessel or that of the burner, it will thus be possible to achieve staged combustion with an injection of fuel which will be directed towards the periphery and downstream of the first central combustion zone, thus enabling the amount of nitrogen oxides produced to be effectively reduced.

The secondary injection means will preferably be in the form of so-called auxiliary tubular lances the main part of which will extend inside the air supply passage in a direction substantially parallel or angularly close to the axis of said passage.

In addition, according to the invention, over their length situated facing the walls of the aperture formed in the wall of the vessel to receive the burner, the auxiliary lances will preferably extend towards the periphery of said aperture, the shape of which they will substantially follow. In this way, the problems of turbulence in the flow will be considerably reduced, the deposition of unburned residues on the lances will be limited, and a second combustion zone sufficiently and correctly distant from the first will be obtained under the best conditions.

In many burners the problems of unstable combustion and of pollution are often accompanied by the problem of difficult mounting or dismantling of the component parts of the burners, because of their relative compactness and their need for periodic servicing.

Another aim of the invention is thus to provide a burner construction permitting easy mounting and dismantling, thereby increasing their flexibility of use.

For this purpose, according to the invention, the auxiliary lances will be mounted on the burner, inside the air supply passage, in such a manner as to be pivotable about the general axis of their main part, and their terminal part will be so shaped and have a length such that by turning the lance about its axis said terminal part can be brought inside an imaginary substantially cylindrical envelope coaxial to said passage and having a section smaller than or equal to the minimum section of the latter.

It will be noted that this construction will make it possible to remove one or more lances through the rear of the burner (that is to say on the side remote from the vessel), without having to detach the burner from the wall of the vessel to which it is fixed. If the operation of the burner has to be stopped, the stoppage will therefore be limited.

In addition to the burner as just described above, the invention also relates to a process for burning liquid or gaseous fuel with low pollution through production of nitrogen oxides.

This process, in which at a given moment during combustion a total amount of pressurized air at least sufficient to burn, under substantially stoichiometric conditions, a total amount of fuel(s), is characterized according to the invention in that the total amount of air is circulated in a single passage which leads into the hearth of the vessel and, at a first level situated upstream of the hearth, of the total amount of fuel a part necessary to obtain combustion under substantially stoichiometric conditions with the circulating air is injected, and at a second level situated downstream of the first the remainder of the fuel is injected in such a manner as to achieve combustion under substantially stoichiometric conditions.

In order to operate the burner according to the invention, at least 20% of the total fuel supplied to the burner will in practice preferably be injected with the aid of said auxiliary lances.

If the lances are not fed with fuel while the burner is in operation, they can advantageously be cooled by the circulation of an incombustible gas.

Further characteristics and advantages of the invention will emerge from the description given below with reference to the accompanying drawings, in which.

It will be noted at once that in the different figures the same parts or components have been given the same references.

This being the case, reference will first be made to FIGS. 1 and 2, which show a first form of construction of the burner, of the swirl vane type. In order to receive this burner an aperture 14 has been formed in the wall 12 of the shell of a vessel, for example a furnace or boiler. The aperture 14 here has a substantially frustoconical shape widening towards the interior, given the reference 1, of the vessel which is to be heated.

Figure 1:
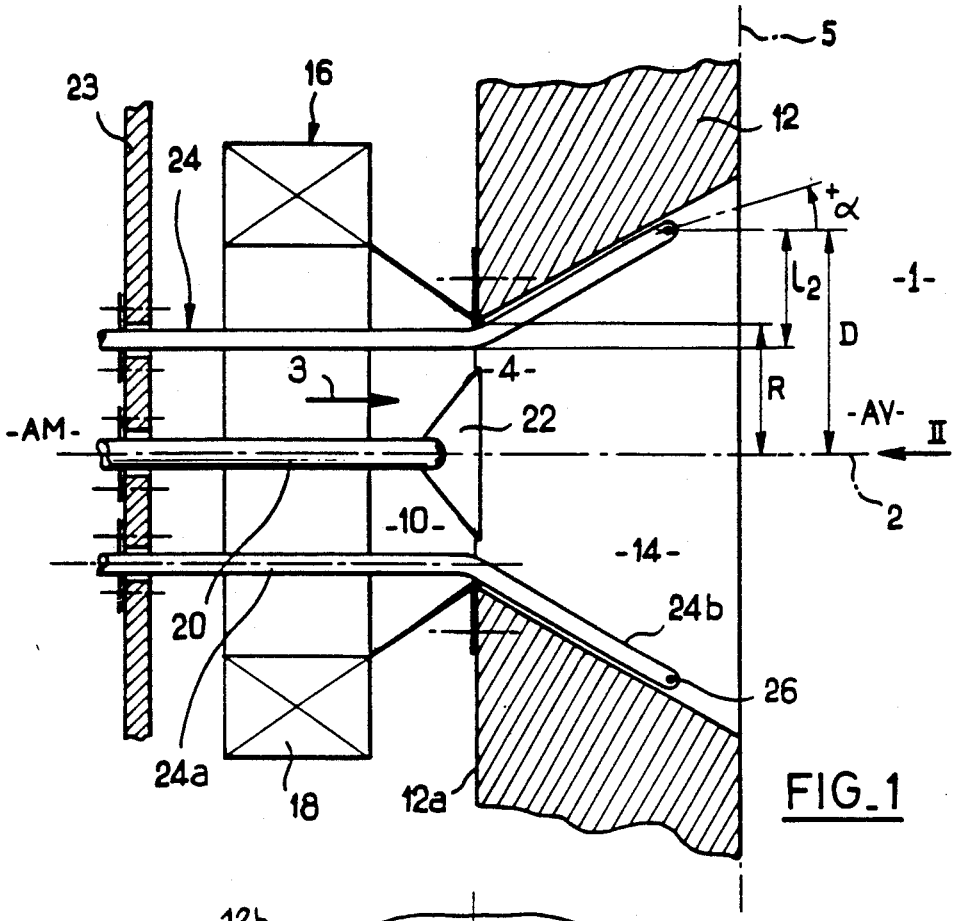
FIG. 1 is a schematic view in longitudinal section, through a substantially median plane, of a first form of construction of the burner of the invention.

Referring more particularly to FIG. 1, it can be seen that the burner in question is fixed (for example by a screw connection, not shown) on the outer face 12*a* of the wall 12 of the vessel, so that its air supply duct 10, which here has a shape converging in the general direction of the flow towards the vessel, is situated substantially coaxially to the axis 2 of the aperture 14 into which it leads and with which it forms a circulation passage for the air for combustion.

As illustrated, the duct 10 is placed in a pressurized air supply box or damper 16, with which it is in communication.

In addition, it is closed at its upstream end by a wall 23 and the air, or more generally speaking the comburent fluid selected, passes from the box 16 into the duct by way of peripheral slots equipped with vanes or flaps (shown schematically at 18) which impart a rotary movement to the air, thus creating suction in the axis 2 of the burner and assisting the mixing of the fuel and the air for combustion.

In FIG. 1 the references AM and AV designate respectively the upstream and downstream sides of the burner, referring to the direction of circulation of the fluids flowing from the rear to the front of said burner. An arrow 3 indicates the direction in question.

A first part of the fuel is here supplied via a pipe 20 which is disposed substantially in the axis 2 of the duct and forms the primary injection means, thus defining a first combustion zone.

The injection end of the pipe, which is situated approximately at the neck 4 of the air supply duct, is equipped with a flame cone 22, the purpose of which is to produce turbulence in the current of air and to promote combustion. The pipe 20 is fixed on the rear wall 23 of the air box 16, for example with the aid of a flange or the like (not shown).

For the purpose of staging the injection of fuel and thus to define a second combustion zone situated downstream of the first, the burner is in addition equipped with secondary injection means comprising so-called auxiliary tubular lances 24 which extend further downstream than said primary means (in the present case the pipe 20).

According to the invention, the auxiliary lances 24 are mounted inside the passage formed by the duct 10 and the aperture 14. Furthermore, each of these lances 24 is so shaped as to comprise a main part 24*a* which here extends substantially parallel to the axis 2 of the passage, upstream of its neck 4, and a terminal part 24*b* which extends said main part beyond the neck, facing the aperture 14, and which is bent in relation to said main part so as to diverge from the axis 2. The terminal part 24*b* will preferably extend, close to and along the walls of the aperture 14, substantially parallel to one of its generatrices.

In FIG. 1 it can clearly be seen that in section the distance D between the injection end of the auxiliary lances and the axis 2 of the air supply passage is greater than the distance -R to the neck 4 of said passage.

In order to achieve directed injection of the fuel in this second combustion zone, one or more apertures 26 will be provided towards the end of the lances 24 and the axes of these apertures will be so directed (angle $\alpha$ in FIG. 1) that the part of the fuel injected there will be injected along a frustoconical or hyperboloidal envelope surface, which will be convergent or divergent depending on the type of preferential combustion.

It will be noted that the section of the apertures 26 will determine the outlet speed of the fuel, which will generally be between about 10 and 200 metres per second.

Figure 2:
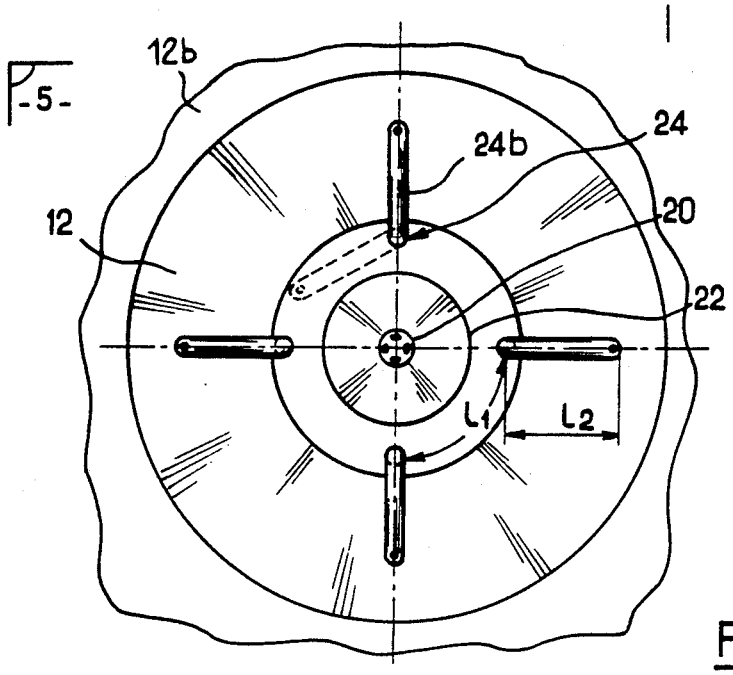
FIG. 2 is a front view, in the direction of the arrow II in FIG. 1, of part of the burner.

In practice, the number of auxiliary lances 24 will generally be between 3 and 16, and these lances will most usually be regularly distributed around the primary injection pipe 20 (FIG. 2). However, in order to facilitate the understanding of the drawing, only two of these auxiliary lances are shown in FIG. 1.

In a general way, the flow of fuel, most usually gaseous fuel, injected by means of these auxiliary lances 24 will be between about 10 and 60% of the total flow of fuel supplied to the burner.

The lances 24 will preferably be fixed individually in their "working" position on the rear wall 23 of the air box, for example by means of flanges (not shown). In this way, after the fastening has been removed it will be possible to pivot the lances 24 to bring them into a "folded back" position as shown in broken lines in FIG. 2. As can be seen, the terminal part of these lances will then be situated inside an imaginary substantially cylindrical envelope coaxial to the air supply passage and having a section smaller than, or in the extreme case equal to, the section at the neck 4 of said passage. According to the invention, in order to permit easy withdrawal of the lances 24 from the burner, after they have been brought into their folded back position, the length $L_1$ which in a plane 5 substantially perpendicular to the axis 2 separates the main parts of two adjacent auxiliary lances will at least be slightly greater than the length $L_2$ of their terminal part, projected into this same plane 5 (see FIG. 2).

Thus, in the "folded back" position the terminal part 24*b* of the lances will easily be able to pass between the neck 4 of the passage and the widest edge of the flame cone 22, and it will be understood that by pulling the lance in question towards the rear of the burner, substantially in the axis 2, it will be possible to extract it easily without stopping the burner. Passages of suitable dimensions and shape will then of course have been provided in the wall 23.

Figure 3:
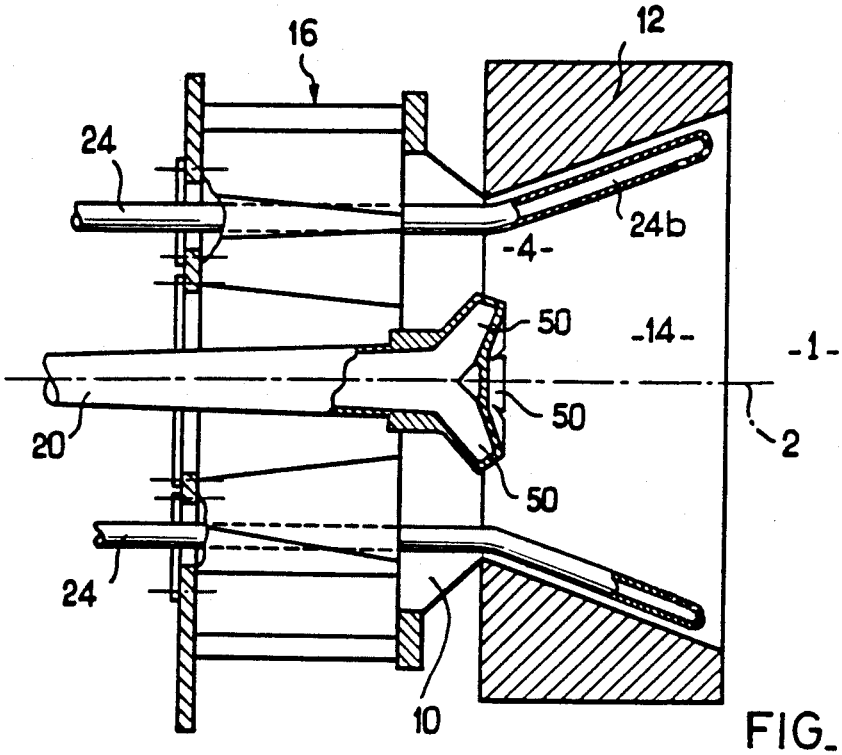
FIGS. 3 to 6 are schematic views, in longitudinal section identical to that in FIG. 1, of different variant constructions of the burner of the invention.

Referring now to FIG. 3, which illustrates a second embodiment of the invention differing from the previous one essentially in respect of the shape of the primary fuel injection pipe 20 (the fuel being for example gas), which at the neck 4 of the air supply passage ends in a series of injection fingers 50 disposed substantially radially in the shape of a star.

It will be noted that the burner illustrated is once again of the peripheral air admission type, comprising a damper equipped with swirl vanes.

The arrangement and shape of the auxiliary fuel injection lances 24, which are distributed around the pipe 20 in the air duct, are entirely comparable with those in the previous embodiment.

Figure 4:
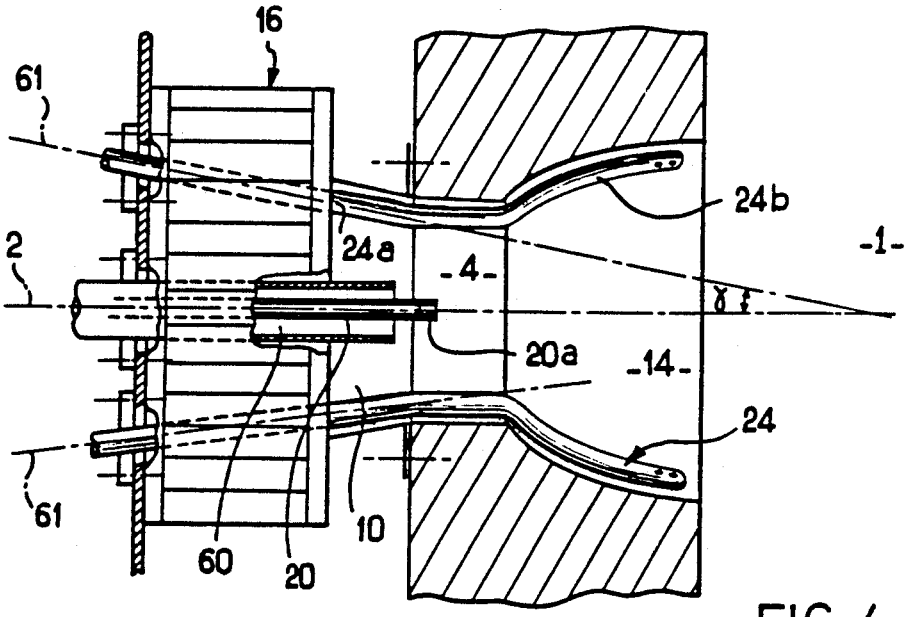

FIG. 4 shows a third embodiment of the invention, the particular feature of which, in contrast to the previous embodiments, is its primary fuel injection system, the shape of its auxiliary lances and the shape of the aperture provided in the wall to receive the burner.

More precisely, the primary injection pipe 20 is here disposed inside a tube 60, from which it projects only at its injection end 20*a* and in which a liquid or gaseous fuel other than that feeding the injection pipe can circulate. When the injection pipe is fed with fuel gas, the tube 60 could for example be supplied with fuel oil.

The aperture 14 provided in the wall has, referring to the direction of flow, first a substantially cylindrical shape, which is then followed by a kind of truncated hyperbola "widening out" towards the vessel 1.

With regard to the auxiliary lances 24, of which only two are shown, their main part 24*a* extends, as far as the inlet forming the neck 4 of the aperture 14, along axes 61 converging in the direction of the aperture, while their terminal part 24*b* then substantially follows the shape of the walls of said aperture, into the interior of which it discharges.

In practice the angular distance Y between the axes 61 of the main part of the lances and the axis 2 of the pipe 20 and of the tube 60 will be relatively short and, generally, between about 5° and 30°.

It will be noted that the burner shown in FIG. 4 is once again of the peripheral air admission type comprising an air box 16 equipped with swirl vanes.

Figure 5:
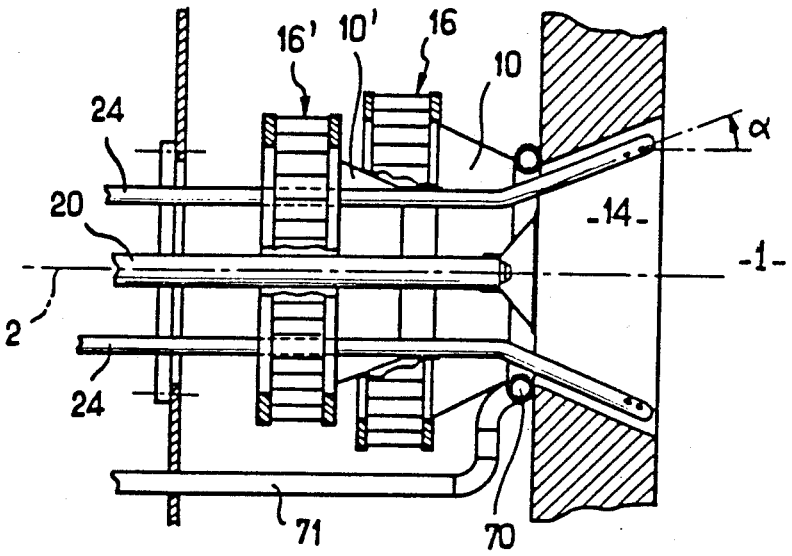

Referring now to FIG. 5, a fourth embodiment of the invention can be seen illustrated here.

This variant can be compared with that shown in FIG. 1 in respect of the frustoconical shape of the walls of the aperture 14, the provision, in the axis 2 of the air supply duct, of a primary fuel injection pipe 20 which opens into the duct at its neck 4, and in respect of the arrangement of the auxiliary lances 24 (of which here again only two are shown). In addition, the burner is once again of the peripheral air admission type, but here has two air boxes 16, 16', the duct 10' of one of them 16', leading into the duct 10 of the other 16.

Apart from this, the present embodiment differs essentially because of the provision of a tubular toroidal crown 70 which extends on the periphery of the air supply duct at the connection between the duct 10 and the aperture 14.

In practice the crown 70, which is connected to a fuel supply tube 71, will serve to inject this fuel through apertures (not shown) provided for the purpose substantially at the position where the pipe 20 injects its fuel, thus defining the primary combustion zone.

With a burner of this kind it would for example be possible to inject fuel gas through the crown 70 and fuel oil through the pipe 20, while the auxiliary lances 24 in turn could inject gas in the second combustion zone.

Figure 6:
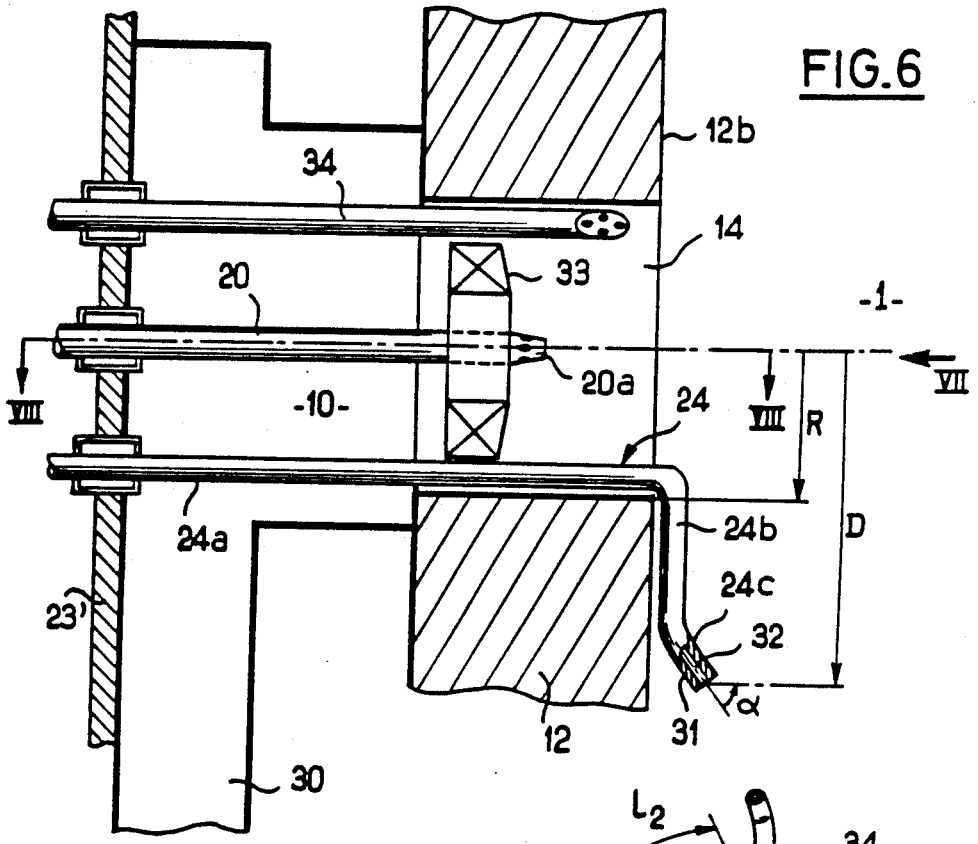
Figure 7:
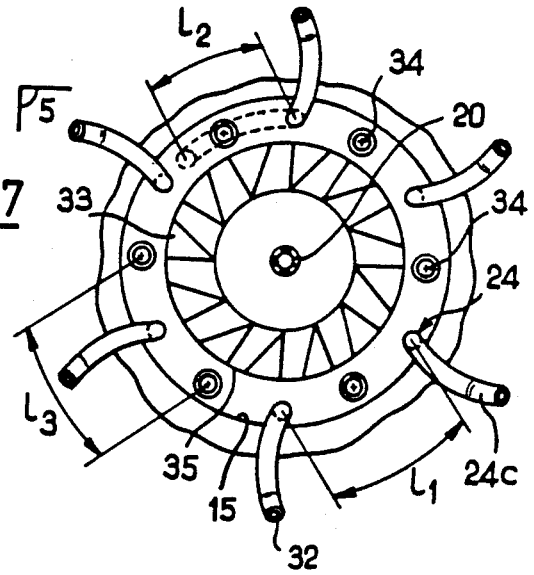
FIG. 7 is a view in the direction of the arrow VII of the burner shown in FIG. 6.
Figure 8:
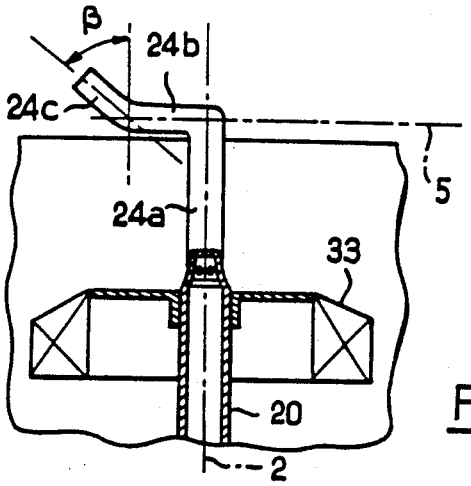
FIG. 8 is a schematic view, partly in section on the line VIII—VIII, of the burner shown in the same FIG. 6.

Referring now to FIGS. 6 to 8, a fifth embodiment of the invention is shown here.

The burner shown is of the axial or parallel air flow multi-lance type.

More precisely, the burner here comprises a box or casing 30 fed with pressurized air and leading into the duct 10, without the air being subjected to rotation as was the case in the previous embodiments.

In addition, the present burner is characterized in that for the purpose of effecting the primary injection of fuel it is provided, additionally to its central pipe 20, with so-called "primary" lances 34 distributed around said central pipe.

In the example illustrated the primary lances in question are each intercalated between each two adjacent auxiliary lances 24 (FIG. 7) and discharge, slightly downstream of the injection end 20*a* of the pipe 20, inside the aperture 14, which here has a substantially circular cylindrical shape with its cylinder axis disposed in the axis 2.

In FIG. 6 only one of the primary lances is shown. It will be observed that this lance extends substantially parallel to the axis 2 of the passage, close to the walls of the latter. It will also be observed that the pipe 20 carries, surrounding it, a kind of disc 33 provided with vanes intended to rotate the air about the axis 2.

Taking into account the shape of the aperture 14, the auxiliary lances 24 are here mounted in such a manner that their main part 24*a* extends substantially parallel and close to the walls of the aperture as far as the face 12*b* of the wall 12 on the side facing the interior of the vessel, while they are extended by their terminal part 24*b* inside said vessel, diverging from the axis 2.

In practice, this terminal part, which could be rectilinear or curvilinear (see FIG. 7), will extend substantially parallel to the inside wall 12*b* of the wall of the vessel.

In the case under consideration the terminal part of the lances 24 is directed, in one and the same plane, at about 90° to their main part.

As can clearly be seen in FIG. 6, each of the terminal parts in question could be extended by a short end part 24*c* directed obliquely and having at least one injector 31 with its fuel ejection aperture 32. The oblique orientation of this end part could in particular be situated in the plane containing the main part 24*a* of the lances and the junction point between their terminal and end parts (angle $\alpha$, FIG. 6).

Said end part 24*c* could in addition extend along an axis directed obliquely in relation to the plane containing the main part of the auxiliary lances and the junction point between the terminal and end parts (angle $\beta$, FIG. 8). In this case the fuel injection angle at the auxiliary lances will therefore be defined by the orientation of the end part in question and be conditional on the angles $\alpha$ and $\beta$ selected.

Nevertheless, it would have been possible to provide terminal parts 24*b* without end parts, in which case the fuel injection angle would be defined at that point by the orientation (angles $\alpha$ and/or $\beta$) of the aperture 32 of the injectors 31.

In practice, taking as reference an axis parallel to that of the air supply duct, an angle $\alpha$ between $-40°$ and $+70°$ and an angle $\beta$ between $-60°$ and $+60°$ will make it possible, depending on the type of combustion selected, to achieve convergent or divergent injection of the fuel jets at the ends of the auxiliary lances.

With regard to the dimensions of the terminal (and, where applicable, end) parts, the length $L_1$ separating the main parts of two adjacent auxiliary lances will preferably be adapted, as in the previous embodiments, so that it is at least slightly greater than the length $L_2$ of their terminal part (extended, where applicable, by the end part).

In the present case it will in addition be preferable to provide (once again in section) a length $L_3$ separating two adjacent primary lances which is at least slightly greater than the length $L_2$ (FIG. 7).

Thus, if care is taken to fix the lances on the burner by providing the rear wall 23' of the duct 10 with slots shaped to enable the auxiliary lances 24 to be turned about the general axis 2 of the air supply duct, independently of the primary lances 34, for the purpose of extracting them from the burner it will be sufficient to pivot them, on the one hand, about the axis of the main part 24*a*, so as to bring them into the "folded back" position (shown in broken lines in FIG. 7), and on the other hand about the axis 2, so as to be able to extract them towards the rear of the burner without causing them to collide with the primary lances.

In this connection it will be observed on examining FIG. 7 that in the folded back position the terminal part (extended, where applicable, by the end part) of the auxiliary lances will then extend between the wall 15 of the aperture 14 and the outer edge 35 of the turbulence disc 33.

Figure 9:
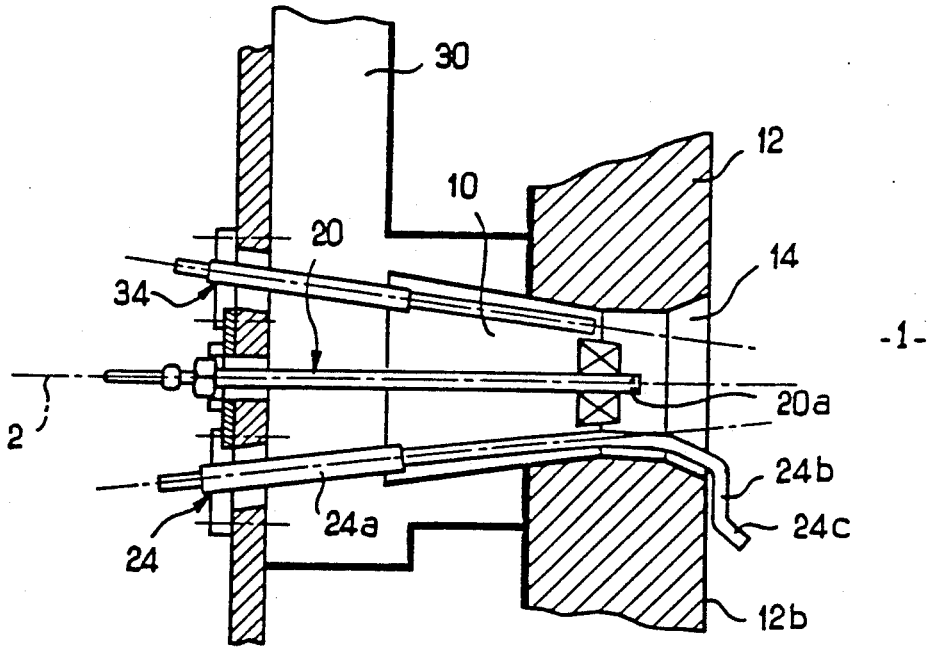
FIG. 9 is a view in longitudinal section, identical to that in FIGS. 3 to 6, illustrating another form of construction of the burner of the invention.

Reference will now finally be made to FIG. 9, in which a sixth form of construction of the burner of the invention is illustrated.

Like the previous one, this burner is of the parallel air admission, multiple primary lance type.

It therefore comprises a series of primary lances 34 distributed around a central pipe 20 (although it is not indispensable to provide a central pipe), and the pressurized air which passes from the box 30 into the duct 10 and then into the aperture 14 does not at this point undergo any rotary movement.

As illustrated, the aperture 14 which has been provided in the wall 12 of the vessel here first has a frustoconical shape, convergent in the direction of flow, and then a substantially circular cylindrical shape with the axis 2, and then finally a divergent frustoconical shape. Consequently, both the primary lances 34 and the facing main part 24*a* of the auxiliary lances extending as far as the neck of the aperture 14 are directed along converging directions, moving closer together in the direction of said aperture. As already indicated with reference to FIG. 4, the angular distance between them will in this case generally be between about 5° and 30°.

Since in FIG. 9 a central pipe 20 has been provided, it will be observed that it leads into the aperture 14 slightly downstream of the injection end of the primary lances 34.

Study of FIG. 9 will also show that once again, likewise for the sake of clarity, only one primary lance and one auxiliary lance have been shown, although their arrangement in practice is usually as shown in FIG. 7.

With regard to the auxiliary lances 24, it will be observed that, over their length situated facing the walls of the aperture 14, they extend according to the invention towards the periphery of the aperture, the wall contour of which they substantially follow, and that, taking into account its shape starting as a "bottleneck", they are extended in the vessel 1 by a terminal part 24*b* and an end part 24*c* of the type described in connection with FIGS. 6 to 8, the terminal part 24*b* extending parallel to the face 12*b* of the wall.

The different forms of construction of the burner principally envisaged having been described, the general operating principle will now be explained.

Before this is done, it would appear important to note at this stage of the description that all the embodiments envisaged can be combined or associated with one another.

This being the case, any one of these embodiments operates in accordance with the invention in such a manner that at a given moment during combustion the burner is fed with a total amount of air, under suitable pressure, at least sufficient to burn a total amount of fuel(s) under substantially stoichiometric conditions.

The air for combustion introduced will therefore all circulate inside the passage formed by the duct 10 and the aperture 14, before being discharged onto the hearth of the vessel 1.

Although the invention makes no provision for the staging of the admission of the air for combustion, on the other hand it does provide for the staging of fuel injection. For this purpose the primary injection means (20 and/or 34) will therefore inject, at a first point situated upstream of the hearth, a part of the total amount of fuel necessary to obtain combustion under substantially stoichiometric conditions with the circulating air, while the remainder of the fuel will be injected by the auxiliary lances 24 at a second point located downstream of the first, so as then to achieve substantially stoichiometric combustion conditions. At the site of this second zone the combustion will therefore be effected between the excess air which was not consumed at the site of the first combustion zone and the part of the fuel which was injected by the auxiliary lances. Taking into account the relative arrangement of the primary and secondary injection means, it is clear that the flame resulting from the secondary combustion will, inside the vessel, envelop and extend the flame resulting from the primary combustion.

It will have been noted that in the drawings the means for lighting the burner are not shown. This was done for the sake of clarity. Nevertheless, it should be clear that such means will actually be provided in order to be able to ignite the mixture of air and fuel at the combustion zones mentioned. As is known per se, these means could for example consist of suitably insulated electrodes fed with an appropriately high voltage.

Finally, it will be noted that although generally speaking the burner air supply pressure will be higher than atmospheric, it would also be possible to envisage feeding said burner at subatmospheric pressure.

We claim:

1. A burner for liquid or gaseous fuels which is mounted on a wall of a vessel substantially axially opposite an aperture provided through the wall, the burner comprising:

an air supply box and a duct in communication therewith;

said duct and said aperture forming a single air supply passage through which all air used for combustion circulates;

primary fuel supply means extending towards said vessel within said air supply passage; and secondary fuel supply means extending towards said vessel within said air passage, said secondary fuel supply means comprising at least one supply member having a main part disposed codirectionally with a flow axis of said air supply passage, and a terminal part extending towards said vessel, said terminal part being angularly positioned relative said main portion.

said terminal part extending towards said vessel further than said primary fuel supply means, a tip end of said terminal part being positioned at a radial distance from said air supply passage flow axis greater than a minimum radial dimension of said passage.

2. The burner according to claim 1, wherein said primary fuel supply means are positioned substantially centrally of said air supply passage along the flow axis thereof;

said secondary fuel supply means comprising a plurality of tubular lance-like members, said main parts of said members extending inside said air supply passage in a direction substantially parallel or angularly close to the flow axis of said air supply passage.

3. The burner according to claim 1, wherein said secondary fuel supply means comprises a plurality of lance-like members, the main part of each extending inside said air supply passage in a direction substantially parallel or angularly close to said air flow axis.

4. The burner according to claim 3, wherein at least a portion of each of said lance-like members extends towards a periphery of said aperture and follows the shape of walls defining said aperture.

5. Burner, according to claim 3, characterized in that, particularly in the case where the aperture provided through the wall has a shape which widens out in the direction of flow towards the vessel, the terminal part of the auxiliary lances extends and ends inside said aperture.

6. The burner according to claim 3, wherein said lance-like members are mounted on said burner in such a manner as to be pivotable about said main part, and said terminal part of said lance-like members has such a shape and a length that by rotation of said lance-like members about their main part, said terminal part can be brought inside an imaginary substantially cylindrical envelope coaxial to said air supply passage and having a section smaller than or equal to the minimum section of said passage.

7. The burner according to claim 3, wherein in a plane substantially perpendicular to the air passage, flow axis, the main parts of two adjacent secondary fuel supply members are disposed at a greater distance than a length projection of the members terminal parts to said plane.

8. The burner according to claim 1, wherein said aperture has a substantially cylindrical shape, the main parts of said lance-like members extending only within said air supply passage, the terminal parts of said members extending beyond said air supply passage and into said vessel.

9. The burner according to claim 8, wherein the terminal part of each lance-like member includes a tip end part oriented obliquely with respect to a rest of said terminal part.

10. The burner according to claim 9, wherein the terminal part of each lance-like member is disposed in a plane containing its main part and a junction point between said terminal part and the tip end part.

11. Burner according to claim 9, characterized in that said end part extends on an axis directed obliquely in relation to the plane containing the main part of the auxiliary lances and the junction point between the terminal part and the end part of said lances.

12. The burner according to claim 1, wherein said primary fuel supply means comprises a pipe-like member disposed substantially codirectionally with the longitudinal axis of said duct.

13. The burner according to claim 12, wherein said pipe-like member is inserted in a disc-like element, said disc-like element having vanes to rotate air about an axis of said pipe-like member.

14. The burner according to claim 1, wherein said primary fuel supply means comprises:

a first fuel supply means positioned substantially centrally of said air supply passage along the flow axis of said passage;

a second fuel supply means positioned around said first fuel supply means and along said air supply passage.

15. The burner according to claim 14, wherein said first fuel supply means is a pipe-like member;

said second fuel supply means is a first plurality of tubular lance-like members extending inside said air supply passage in a direction substantially parallel or angularly close to the flow axis of said air supply passage, said first plurality members being disposed around said first fuel supply means in a pre-determined pattern; and said secondary fuel supply means is a second plurality of tubular lance-like members the main parts of which extend inside said air supply passage in a direction substantially parallel or angularly close to the flow axis of said air supply passage, said second plurality members being disposed around said first fuel supply means in a pre-determined pattern.

16. A burner for liquid or gaseous fuels which is mounted on a wall of a vessel substantially axially opposite an aperture provided through the wall, the burner comprising:

an air supply box and a duct in communication therewith;

said duct and said aperture forming a single air supply passage through which all air used for combustion circulates;

primary fuel supply means extending towards said vessel within said air supply passage; and secondary fuel supply means extending towards said vessel within said air passage, said secondary fuel supply means comprising a plurality of elongated tubular lance-like members each having a main part disposed substantially codirectionally with a flox axis of said air supply passage, and a terminal part extending towards said vessel and angularly positioned relative its associated main portion.

said terminal parts each having a tip end positioned at a radial distance from said air supply passage flow axis grater than a minimum radial dimension of said passage, the terminal part of each tubular member being disposed in a plane substantially parallel to the face of the vessel wall which is directed towards an interior vessel space.

17. A burner for liquid or gaseous fuels which is mounted on a wall of a vessel substantially axially opposite an aperture provided through the wall, the burner comprising:

an air supply box and a duct in communication therewith;

said duct and said aperture forming a single air supply passage through which all air used for combustion circulates;

primary fuel supply means extending towards said vessel within said air supply passage; and secondary fuel supply means extending towards said vessel within said air passage, said secondary fuel supply means comprising a plurality of elongated tubular lance-like members each having a main part disposed substantially codirectionally with a flow axis of said air passage, and a terminal part extending towards said vessel and angularly positioned relative its associated main portion, said terminal parts each having a tip end positioned at a radial distance from said air supply passage flow axis grater than a minimum radial dimension of said passage, the terminal part of each tubular members being disposed in a plane substantially perpendicular to the axis of its associated main part.

18. Burner according to claim 1, characterized in that the terminal part of the auxiliary lances is rectilinear.

19. The burner according to claim 17, wherein the terminal part of each lance-like member is curvilinear.

20. A burner for liquid or gaseous fuels which is mounted on a wall of a vessel substantially opposite an aperture provided through the wall, the burner comprising:

an air supply box and a duct in communication therewith;

said duct and said aperture forming a single air supply passage through which all air used for combustion circulates;

primary fuel supply means extending towards said vessel within said air supply passage; and secondary fuel supply means extending towards said vessel within said air passage, said secondary fuel supply means comprising a plurality of elongated tubular lance-like members each having a main part disposed substantially codirectionally with a flow axis of said air supply passage, and a terminal part extending towards said vessel and angularly positioned relative its associated main portion.

said terminal parts each having a tip end positioned at a radial distance from said air supply passage flow axis grater than a minimum radial dimension of said passage, said primary fuel supply means comprising a first plurality of tubular lance-like members disposed around the air supply passage flow axis, and said secondary fuel supply means is a second plurality of tubular lance-like members disposed around said flow axis, each of said lance-like members of said second plurality being interposed between two of said lance-like members of said first plurality, in a plane perpendicular to said flow axis, the distance between adjacent lance-like elements of first plurality being greater than the length of the terminal parts of said first plurality members.

* * * * *

UNITED STATES PATENT AND TRADEMARK OFFICE

CERTIFICATE OF CORRECTION

PATENT NO. : 4,925,387

DATED : 5/15/90

INVENTOR(S) : Phillippe Locanetto

It is certified that error appears in the above-identified patent and that said Letters Patent is hereby corrected as shown below:

Claim 5, column 9, line 21, change "the auxiliary lances" to --the lances--.

Claim 16, column 10, line 39, change "flox" to --flow--.

Claim 18, column 11, line 7, change "1" to --3--.

Claim 18, column 11, line 8, delete "auxiliary".

Signed and Sealed this

Eleventh Day of August, 1992

*Attest:*

DOUGLAS B. COMER

*Attesting Officer*

*Acting Commissioner of Patents and Trademarks*